United States Patent [19]

Paterra et al.

[11] Patent Number: 5,015,108

[45] Date of Patent: May 14, 1991

[54] RIBBON PRINT TRACK REINKING WITH A ROLL SYSTEM

[75] Inventors: Jeffrey H. Paterra, Charlotte, N.C.; Donald K. Rex, Highland Beach, Fla.

[73] Assignee: International Business Machines Corporation, Armonk, N.Y.

[21] Appl. No.: 535,638

[22] Filed: Jun. 11, 1990

Related U.S. Application Data

[63] Continuation of Ser. No. 360,182, Jun. 1, 1989, abandoned.

[51] Int. Cl.[5] ..... B41J 31/16; B41J 31/14; B41J 27/12

[52] U.S. Cl. ..... 400/197; 400/202.2; 400/202.4

[58] Field of Search ..... 400/197, 200, 201, 202.1, 400/202.4, 199, 202

[56] References Cited

U.S. PATENT DOCUMENTS

| | | | |
|---|---|---|---|
| 4,071,133 | 1/1978 | Scherrer et al. | 197/168 |
| 4,091,914 | 5/1978 | Stipanuk | 400/196.1 |
| 4,153,378 | 5/1979 | Scherrer | 400/196.1 |
| 4,352,577 | 10/1982 | Chida et al. | 400/196.1 |
| 4,636,097 | 1/1987 | Goubeaux | 400/196.1 |
| 4,653,947 | 5/1987 | Echols | 400/202.4 |
| 4,657,418 | 4/1987 | Lahr | 400/248 |
| 4,747,711 | 5/1988 | Motta et al. | 400/196.1 |

FOREIGN PATENT DOCUMENTS

| | | | |
|---|---|---|---|
| 417343 | 6/1947 | Italy | 400/202.4 |
| 15778 | 1/1988 | Japan | 400/197 |

OTHER PUBLICATIONS

International Application published under PCT, #WO 85/01017 NCR Corp., Ribbon Cassette for Use in Printer, Mar. 1985, all pages.

Rethinking Reinking: New Materials Extend Ribbon Cartridge Life, 1986, Annual Guide to Ribbons & Toner, pp. 84 through 88.

*Primary Examiner*—Clifford D. Crowder
*Assistant Examiner*—Joseph R. Keating
*Attorney, Agent, or Firm*—Calfee, Halter & Griswold

[57] ABSTRACT

Apparatus for selectively reinking an endless ribbon in that portion of the ribbon known as the ribbon print track. The ribbon print track is created in an endless ribbon by the repeated striking of the ribbon by a print mechanism thereby deforming the ribbon and depleting it of ink. Reinking the entire ribbon uses more ink than is necessary. Reinking only the print track extends the life of the ribbon by selectively using the available supply of ink. The apparatus achieves this result by use of an ink reservoir which supplies ink to a drive roller, which through a rotating pinching movement in cooperation with another roller, advances a ribbon into a stuffing cavity of an ink cartridge. The ink reservoir is rotatably mounted and formed to apply ink only to that portion of the drive roller which corresponds to the print track of the ribbon. The drive roller may be a composite of more than one roller in a stack of rollers and a single roller in the stack of rollers may receive the ink from the ink reservoir and transfer it to the ribbon print track.

14 Claims, 3 Drawing Sheets

6
8
12
10
16
2
4

Fig. 6
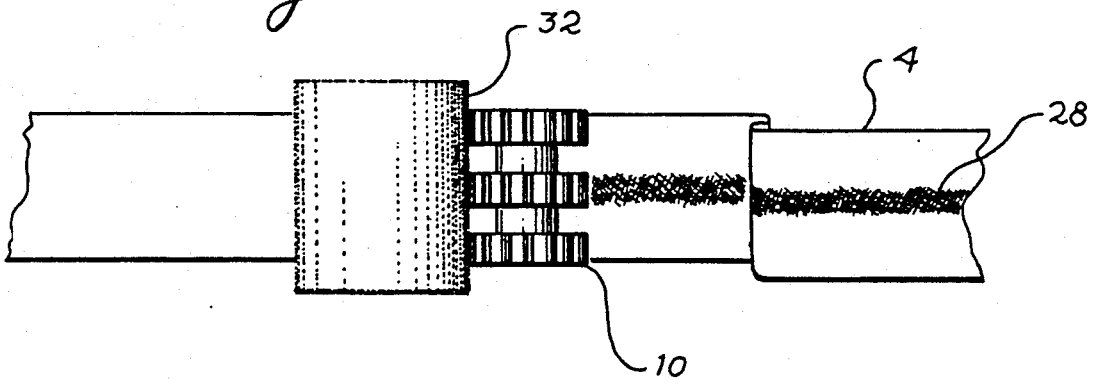
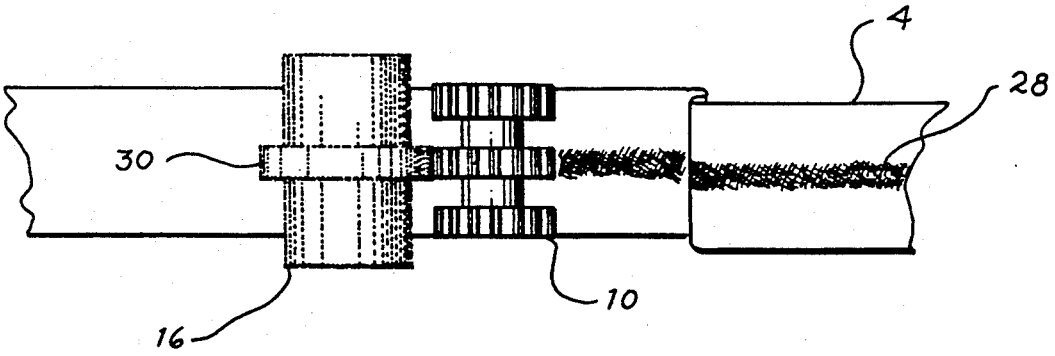
Fig. 7

RIBBON PRINT TRACK REINKING WITH A ROLL SYSTEM

BACKGROUND OF THE INVENTION

Field and Background of the Invention

The invention is a continuation of application Ser. No. 360,182 filed June 1, 1989 entitled Ribbon Print Track Reinking With A Roll System and relates generally to the field of ribbon cartridges for use in computer printers, typewriters and the like, and relates more specifically to a reinking device which reinks the portion of an endless ribbon which is struck by a print mechanism to create characters. Endless ribbons are reinked to extend their life by various techniques. This device provides for extended ribbon life by applying ink only to the area of a ribbon which has had its ink depleted, which is known as the ribbon print track, and not the entire ribbon area.

Existing art provides differing solutions to the need to reink endless ribbons to extend their useful life. Generally ribbon is fed from a cartridge to a print mechanism by a guide means and thereafter gathered back into the cartridge. As the ribbon is gathered into the body of the cartridge it is reinked by applying ink to the ribbon by contact applicators. In the present state of the art ink is applied to the entire ribbon surface, even though only the print track of the ribbon is struck by a print mechanism and ink is depleted in this area. The ribbon material is usually made of nylon fabric which is widely known in the art but other suitable fabrics may be employed as well. As the ribbon is impacted by the print mechanism to contact a print medium, usually paper, the fabric becomes distorted and less able to uniformly distribute ink over the entire surface of the ribbon. In the terminology of the trade, the ribbon loses its wicking ability. The result is that as the ribbon nears the end of its useful life, ink tends to congregate in the areas which forms the edges of the print track of the ribbon where character impact occurs and the characters are printed unevenly with their tops and bottoms being darker than their centers.

Earlier solutions to the problem of reinking include the U.S. Pat. No. 4,071.133 which approaches the reinkng problem by applying ink to a roller which distributes ink onto a ribbon by passing a ribbon between it and a spring mechanism which urges the ribbon into contact with the ink impregnated roller. Both wicks and felt tips communicate with ink inside a reinking unit and apply ink uniformly to the roller surface. One variation is a fork shaped applicator which distributes ink to the roller in areas adjacent the area of the roller that comes into contact with the print track of the ribbon which is normally the strike zone for print characters.

Another solution is set forth in U.S. Pat. No. 4,747,711 which provides a reinking device which is fitted into a cartridge for holding an endless ribbon. In this instance, toothed wheels are biased into engagement and cooperate to engage a ribbon and advance it into a storage chamber of a ribbon cartridge. A reservoir supplies ink by capillary action to one of the toothed rollers which in turn applies it to the ribbon as it engages it and advances it into the storage chamber of the cartridge.

Yet another solution is set forth in U.S. Pat. No. 4,653,947, which provides an endless ribbon housed in a cartridge as set out in the previous recited patents. In this instance the endless ribbon is reinked by a pair of pinch rollers in which one is inked by an ink impregnated porous pinch roller. The pinch rollers are spring biased to engage the ribbon and uniformly apply ink as the rollers cooperate to advance the ribbon into a storage chamber in the cartridge.

These solutions to the need to reink endless print ribbons to extend their life, apply ink to the entire ribbon surface. One variation occurs in the teachings of the 4,071,133 patent, where in one embodiment, the ribbon was reinked in a portion of the ribbon adjacent to the character print track. None of these solutions selectively reinked the strike area of the ribbon which had its ink depleted. Reinking the entire ribbon, rather than only the area depleted by printing, uses the available ink more rapidly than only reinking the area of the ribbon which has had ink depleted.

Therefore, an object of this invention is to reink an endless ribbon only in its print track to extend its useful life.

Another object of this invention is to maintain print character quality over the useful life of the ribbon.

And yet another object of this invention is to provide a universal means for applying coating to a select track or tracks of a ribbon.

SUMMARY OF THE INVENTION

The invention provides for the selective application of a coating to a ribbon material. In the field of computer printers, typewriters and the like, endless ribbons are used to supply ink to a print mechanism for impregnating an image on a medium, usually paper. A common configuration is to use a cartridge which contains ribbon and a fixed or flexible guide connected to the cartridge which guides the ribbon from the cartridge to the area where the printing occurs and in turn redirects the ribbon back to the cartridge. As the ribbon is reused it loses ink and requires reinking to retain its print quality. The ink loss occurs in a band on the ribbon which is known as the print track. The repetitive impact of a printing mechanism on the print track deforms and compresses the ribbon resulting in a loss of its wicking ability to transfer ink to the print track by migration of ink through the ribbon. The apparatus herein described applies ink only to the print track thereby conserving ink.

A cartridge, also known as a stuffing box, has ribbon stored in it and as described, ribbon is drawn from the stuffing box along guides to a print area. A combination drive and transfer roller engages the ribbon by having the ribbon compressed against it by another roller. These rollers may be toothed or otherwise have a ridged surface which intermesh to grasp and advance the ribbon as the drive and transfer roller is rotated. In one embodiment, the combination drive and transfer has segments which are stacked in axial alignment. An ink reservoir, constructed as a rotatable porous body, generally cylindrical, has one or more raised surfaces about its exterior circumference and is aligned so that these raised surfaces engage one or more of the segments of the combination drive and transfer cylinder. In turn, one or more segments of the combination drive and transfer roller are inked in the region of the roller that aligns with the print track or tracks of a ribbon advanced between the combination drive and transfer roller and a pinch roller. As a result, ink is applied only to the print tracks of the ribbon. The advantages to this invention are that the ink available in an ink reservoir in a cartridge last longer allowing extended use of the ribbon. The practice of this invention will achieve at least a 15% improvement in ribbon life and a higher quality print character over the useful life of the ribbon.

BRIEF DESCRIPTION OF THE DRAWINGS

FIG. 6 shows an elevation of a reinking mechanism with a cylindrical reinking reservoir.

FIG. 7 shows an elevation of a reinking mechanism with a cylindrical reinking reservoir with a raised portion on its circumference.

DETAILED DESCRIPTION OF THE INVENTION

Figure 1:
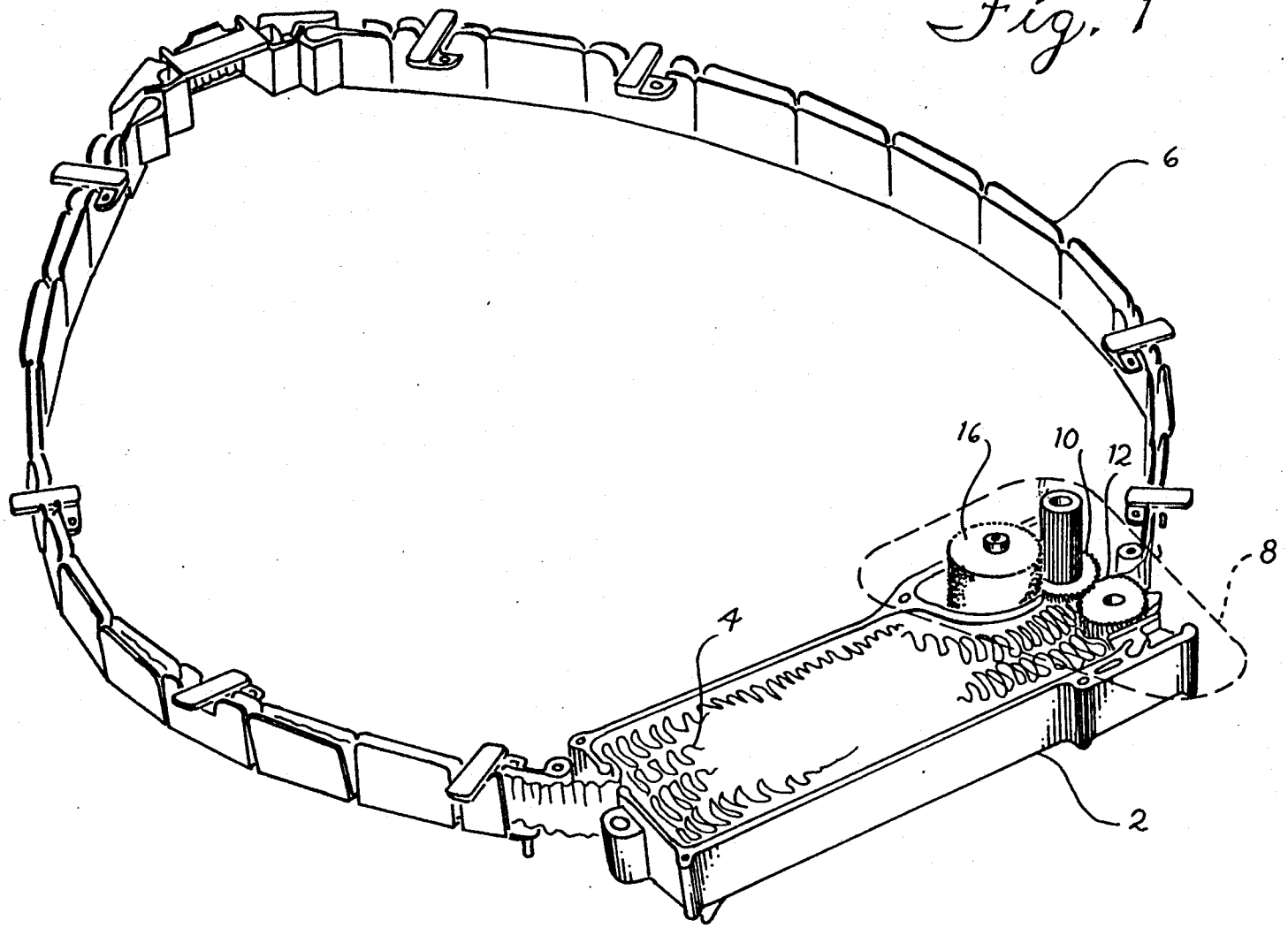
FIG. 1 shows a three dimensional view of an endless ribbon cartridge with the top of the cartridge removed.

Referring to FIG. 1, an endless ribbon cartridge 2 is shown with its top removed to show and endless ribbon 4 stuffed into the cartridge 2. The endless ribbon 4 is fed by a ribbon guide 6 to printing mechanism, not shown, for transfer of ink on the endless ribbon 4 to a print medium, normally paper. The ribbon guide 6 is flexible and known in the art. Shown in the endless ribbon cartridge is a roller system 8 (also shown later in detail at FIG. 4) positioned to act upon the endless ribbon 4 to advance it along the ribbon guide 6 and then stuff it into the body of the endless ribbon cartridge 2.

Figure 2:
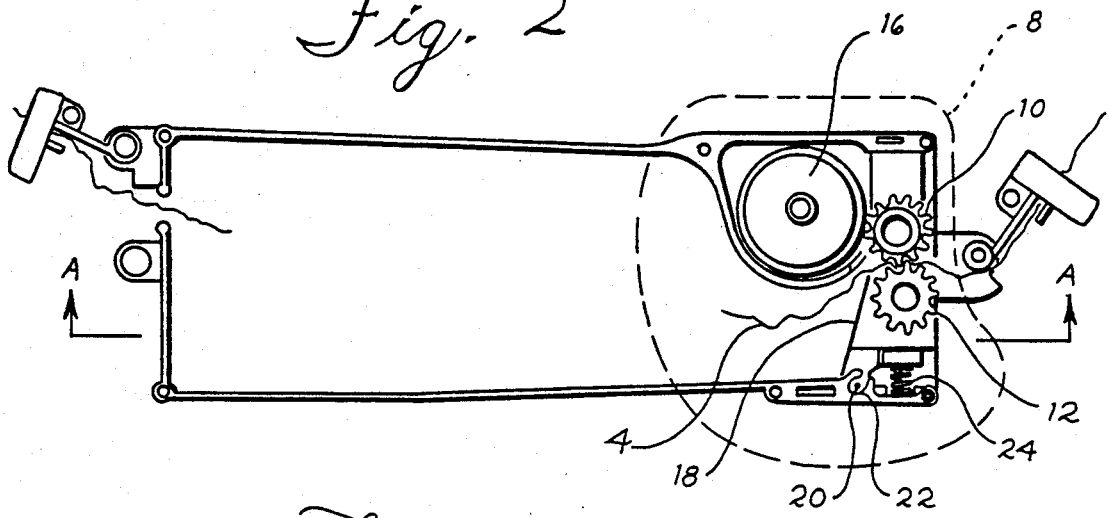
FIG. 2 shows a plan view of a ribbon cartridge with the reinking mechanism.
Figure 3:
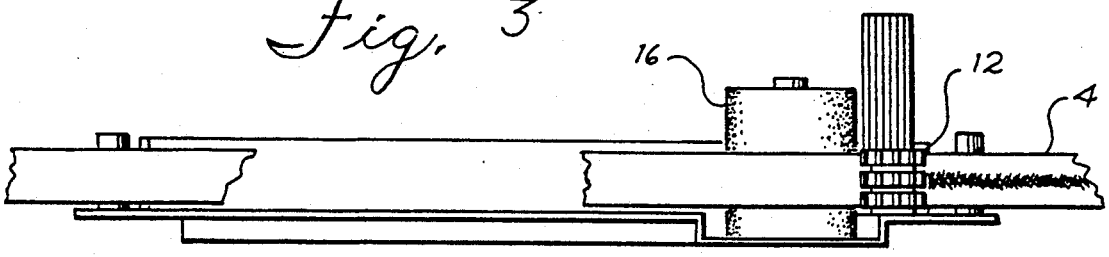
FIG. 3 shows an elevation of a ribbon cartridge along sectional lines A—A.

Referring to FIG. 2, a plan elevation of an endless ribbon cartridge 2 more clearly shows the roller system 8 for advancing the endless ribbon 4. FIG. 3, shows an elevation of the roller system 8 along sectional lines A—A. As shown in this preferred embodiment, roller system 8 has three main components consisting of a pair of toothed rollers 10 and 12, which for purposes of clarity are described as a drive transfer roller 10 and a pinch roller 12. As more clearly shown in FIG. 3, drive transfer roller 10 has an extended drive shaft 14 which has a serrated circumferential surface which is engaged and driven by motive means known in the art. The third component of roller system 8 is an inking reservoir 16 which is positioned adjacent to drive transfer roller 10. Inking reservoir 16 is rotatably mounted with its axis of rotation parallel to the axis of rotation of the drive transfer roller 10 and is located in the endless ribbon cartridge in proximity to the drive transfer roller 10 to come in contact with it and thereby apply ink to it.

Figure 4:
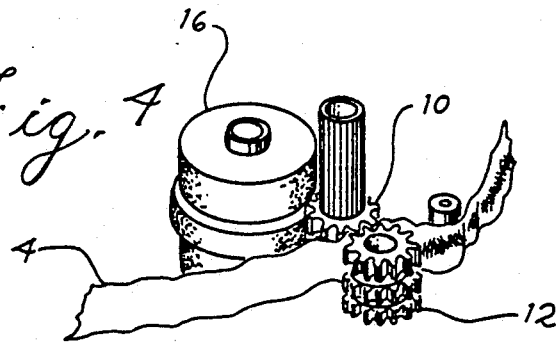
FIG. 4 shows a three dimensional view of a ribbon reinking mechanism.

The operation of roller system 8 is more fully understood by the examination of FIG. 4, where roller system 8 is shown in three dimensional view. From this drawing it can be seen that drive transfer roller 10 and pinch roller 12 are toothed wheels in this embodiment of the invention. Other configurations of the circumference of rollers 10 and 12 may be employed as is appropriate for the ribbon material used. For instance, it is envisioned that the rollers 10 and 12 may be cylindrical with various surface configurations such as smooth, knurled, or abrasive, to give the desired friction for engaging a ribbon 4 and advancing it by the cooperative rotation of rollers 10 and 12 with the surfaces as described.

Pinch roller 12 is biased into engagement with endless ribbon 4 which is pressed into contact with drive transfer roller 10 where it is grasped in the interlocking teeth of the drive transfer roller 10 and pinch roller 12. Pinch roller 12 is rotatably mounted on a bracket 18 which has a protruding arm 20 with a rounded bearing surface at its extremity which fits into a socket 22 formed in the body of endless ribbon cartridge 2 to create a point of rotation for the bracket 18 and in turn pinch roller 12 mounted thereon. A spring 24 is interposed between a portion of the body of the endless ribbon cartridge 2 and bracket 18 to urge the pivotal bracket 18 and in turn the pinch roller 12 mounted thereon into engagement with drive transfer roller 10 so that the teeth of said rollers 10 and 12 intermesh and thereby firmly engage endless ribbon 4 interposed therebetween. The rotation of drive shaft 14 rotates drive transfer roller 10 in a clockwise direction thereby advancing the endless ribbon 4 interposed between it and pinch roller 12 into the endless ribbon cartridge 2, and in turn rotating ink reservoir 16 which is in rotational contact with drive transfer roller 10, to ink drive transfer roller 10.

As shown in this embodiment, drive transfer roller 10 is formed into a cylindrical body having three separate toothed wheels as shown in FIGS. 6 and 7. Likewise, pinch roller 12 has three separate toothed wheels as shown in FIG. 3 and 4. Each set of toothed wheels corresponds in alignment with one another so that when the rollers 10 and 12 are rotatably mounted within the endless ribbon cartridge 2 they intermesh. Inking reservoir 16 is shown in FIGS. 2,3 and 7 in rotatable contact with drive transfer roller 10. FIG. 7 most clearly shows the invention in this embodiment where drive transfer roller 10 has its central toothed wheel 26 in engagement with the print track 28 of endless ribbon 4 to reink only the print track 28.

As can be seen from FIG. 7, inking reservoir 16 has a raised circumferential surface 30 which is in alignment with the central toothed wheel 26 of drive transfer roller 10. The transfer of ink from inking reservoir 16 is accomplished by the contact of its raised circumferential surface 30 and central toothed wheel 26 which in turn is in contact with print track 28 of endless ribbon 4. The significance of this invention is that ink is applied only where it is needed unlike the previous reinking method which is shown for comparison purposes only at FIG. 6 where a cylindrical inking reservoir 32 coats all of the toothed wheels of drive transfer roller 10 which in turn coats more of the surface of endless ribbon 4 than is accomplished by this invention.

By way of illustration only, and for a further understanding of the significance of this invention, the reinking apparatus shown in FIG. 6 inks all three toothed wheels of drive transfer roller 10 which in turn inks the endless ribbon 4 in the print track 28 and adjoining areas of the ribbon as well. This apparatus relies upon the wicking effect of the fabric to migrate ink toward the print track 28. It is this migration of ink to print track 28 that in time cause a gradient in print quality across the print track as the wicking ability of the endless ribbon 4 decrease with use and there occurs a build-up of ink at the edges of the print track. As this condition matures, printed characters have darker tops and bottoms and lighter centers with a resulting unacceptable print quality bringing the endless ribbon 4 to the end of its useful life.

Figure 5:
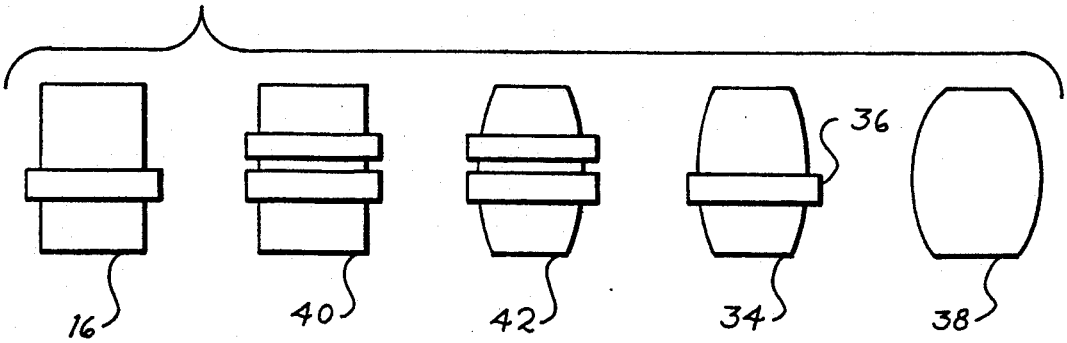
FIG. 5 shows various configurations of reinking reservoirs.

Shown in FIG. 5 is a series of ink transfer rollers. Typically these ink reservoirs are made of porous material for storing and dispensing ink as the body of the ink reservoir is rotated by engagement with the drive transfer roller. A known suitable material for these ink reservoirs is made of Polyolefin, a proprietary product manufactured by Porelon, Inc. Other suitable porous materials may be used to meet the requirements of ink storage and distribution.

Turning again to FIG. 5, shown there is the ink reservoir 16 that has been described in the apparatus as set forth above. This ink reservoir 16 has one raised surface on its circumference which aligns with the central toothed wheel 26 of drive transfer roller 10 which by contact receives ink and then transfers ink to the print track 28 of endless ribbon 4. Another configuration of an ink reservoir has a barrel shape 34 with a raised circumferential surface 36 which when placed in the roller system 8 has its raised circumferential surface 36 align in contact with the central toothed wheel 26 of drive transfer roller 10 for inking print track 28. A second barrel shaped ink reservoir 38 is shown to demonstrate that it too when placed in the roller system 8 may ink a central toothed wheel 26 of drive transfer roller 10 by having the widest portion of its circumference come into contact with the central toothed wheel.

Yet another variation of ink reservoirs is shown in FIG. 5 where a cylindrical ink reservoir 40 and a barrel shaped ink reservoir each has two raised circumferential surfaces. These configurations of an ink reservoir illustrate an application of this invention where two toothed wheels of a drive transfer roller 10 are inked for subsequent inking of two print tracks 28 of and endless ribbon 4. Multiple print tracks can thus be inked by providing the required number of toothed wheels on a drive transfer roller 10 and a corresponding number of raised circumferential surfaces on a rotating ink reservoir for contact transfer of ink to the toothed wheels and thence to the print tracks of an endless ribbon.

Likewise, a single raised circumferential surface on an ink reservoir 16 can ink multiple toothed wheels on a drive transfer roller 10 to thereby ink a print track 28 of a ribbon.

Another embodiment, not shown in the drawings, has separate drive and transfer rollers in which the drive roller is engaged with a pinch roller to advance a ribbon and a transfer roller is spaced separately from the drive roller to receive ink from a generally cylindrical ink reservoir and by contact ink the print track of a ribbon. Various configurations of transfer roller can be envisioned, each with raised circumferences to correspond to a print track or tracks of an endless ribbon or single pass ribbon.

This invention has wider application to coating a ribbon in general. Use of a roller system, as described, with one or more segments of a drive transfer roller receiving a coating material from a reservoir will act to apply a coating selectively to a track or tracks of a ribbon that corresponds to the segments of a drive transfer roller that receives the coating material from the coating reservoir.

From the forgoing description, it will be understood by those having skill in the art that according to the present invention that an apparatus for reinking an endless ribbon print track is provided by a roller system mounted in a ribbon cartridge. While the invention has been particularly shown and described with reference to a preferred embodiment, it will be understood by those skilled in the art that various other changes in form and detail may be made without departing from the spirit and scope of the invention.

What is claimed is:

1. An improved ribbon cartridge assembly for use in computer printers, typewriters and the like comprising, a housing, an endless inked ribbon having a print track that extends a distance less than the width of the ribbon, a printing mechanism, guide means for mounting and guiding said endless ribbon in said housing past said printing mechanism whereat ink on the ribbon is transferred to a print medium, drive transfer roller means rotatably mounted on said housing about an axis of rotation drivingly engaging a major portion of the width of the surface of said ribbon including said print track, means for rotating said drive transfer roller means, pinch roller means rotatably mounted on said housing and having an axis of rotation generally parallel to the axis of rotation of said drive transfer roller, said pinch roller means being spaced from but in proximity to said drive transfer roller means, means biasing said pinch roller means and said drive transfer roller means into engagement with said endless ribbon to advance said endless ribbon, and inking means mounted on said housing, said inking means including a porous material defining an ink reservoir, said ink reservoir having a segment with a circumference greater than that of the remaining portion of the reservoir, said segment being aligned with said drive transfer roller such that only the print track is inked by the ink reservoir, said drive transfer roller being free of engagement of said inking means other than said segment thereof which engages said porous material, whereby, the drive transfer roller drivingly engages a major portion of the ribbon while applying ink only to the print track thereon.

2. The invention as defined in claim 1 wherein the drive transfer roller means includes a toothed roller.

3. The invention as defined in claim 2 wherein the toothed roller includes a plurality of axially spaced segments.

4. The invention as defined in claim 1 wherein the inking means includes an ink carrying roller mounted for rotation on an axis substantially parallel to the axis of the drive transfer roller means.

5. The invention as defined in claim 4 wherein only a portion of the surface of said ink carrying roller engages said drive transfer roller means.

6. The invention as defined in claim 5 wherein said surface of said ink carrying roller is arcuate in longitudinal section where it engages said drive transfer roller.

7. The invention as defined in claim 5 wherein the surface of the ink carrying roller has at least one raised circumferential extending surface, and wherein said raised surface engages said drive transfer roller and the surface other than said raised surface is out of engagement with said drive transfer roller.

8. In a ribbon cartridge assembly for use in computer printers, typewriters and the like, which includes, a housing, an endless inked ribbon having a print track that extends a distance less than the width of the ribbon, a printing mechanism, guide means for mounting and guiding said endless ribbon in said housing past said printing mechanism whereat ink on the ribbon is transferred to a print medium, drive transfer roller means rotatably mounted on said housing about an axis of rotation drivingly engaging a major portion of the width of the surface of said ribbon including said print track, means for rotating said drive transfer roller means, pinch roller means rotatably mounted on said housing and having its axis of rotation generally parallel to the axis of rotation of said drive roller, said pinch roller means being spaced from but in proximity to said drive roller means, and means biasing said pinch roller means and said drive transfer roller means into engagement with said endless ribbon to advance said endless ribbon, an improved method of reinking the ribbon which comprises the steps of;

providing inking means including porous material defining an ink reservoir, providing said ink reservoir with a segment having a circumference greater than that of the remaining portion of the reservoir, applying ink to substantially only that portion of the surface of the driver transfer roller means that engages said print track and not to the portion of the surface of the drive transfer roller means which does not contact said print track during drive motion of the driver roller means by contacting only said portion of said driver roller with said segment of said reservoir and maintaining said surface of said drive transfer roller other than said portion free of engagement of said inking means, whereby, the driver roller drivingly engages a major portion of the ribbon while transferring ink only to the print track thereon.

9. The invention as defined in claim 8 wherein the drive roller means includes a toothed roller.

10. The invention as defined in claim 9 wherein the toothed roller includes a plurality axially spaced of segments.

11. The invention as defined in claim 8 wherein the inking means includes an ink carrying roller mounted for rotation on an axis substantially parallel to the axis of the driver roller means.

12. The invention as defined in claim 11 wherein only a portion of the surface of said ink carrying roller engages said driver roller means.

13. The invention as defined in claim 12 wherein said surface of said ink carrying roller is arcuate in longitudinal section where it engages said drive roller.

14. The invention as defined in claim 12 wherein the surface of the ink carrying roller has at least one raised circumferentially extending surface, and wherein raised surface engages said driver roller and the surface other than said raised surface is out of engagement with said driver roller.

* * * * *